United States Patent [19]

Suga

[11] Patent Number: 4,806,966

[45] Date of Patent: Feb. 21, 1989

[54] TONER IMAGE FIXING DEVICE

[75] Inventor: Takayuki Suga, Tokyo, Japan

[73] Assignee: Kabushiki Kaisha Toshiba, Kawasaki, Japan

[21] Appl. No.: 125,265

[22] Filed: Nov. 25, 1987

[30] Foreign Application Priority Data

Nov. 29, 1986 [JP] Japan ..... 61-284567

[51] Int. Cl.[4] ..... G03G 21/00

[52] U.S. Cl. ..... 355/3 SH; 355/3 FU; 271/312

[58] Field of Search ..... 355/3 SH, 3 FU; 271/307, 311, 312, 313, 900

[56] References Cited

U.S. PATENT DOCUMENTS

| | | | |
|---|---|---|---|
| 3,971,729 | 2/1974 | Steiner | 355/3 SH |
| 4,035,140 | 7/1977 | Tsuda et al. | 271/900 |
| 4,065,120 | 12/1977 | Imaizumi et al. | 271/900 |
| 4,244,648 | 1/1981 | Schultes et al. | 355/3 SH |
| 4,336,992 | 6/1982 | Szlucha et al. | 355/3 SH |
| 4,364,657 | 12/1982 | Landa | 355/3 SH |
| 4,375,327 | 3/1983 | Matsumoto et al. | 355/3 SH |
| 4,408,757 | 10/1983 | Yarm | 271/900 |
| 4,417,800 | 11/1983 | Hirose | 355/3 SH |
| 4,487,158 | 12/1984 | Kayson | 271/900 |
| 4,525,058 | 6/1985 | Hirabayashi et al. | 355/3 SH |

*Primary Examiner*—R. L. Moses

*Attorney, Agent, or Firm*—Cushman, Darby & Cushman

[57] ABSTRACT

A toner image device includes a separating member for separating an image forming medium carrying a toner image to be fixed from fixing rollers. The separating member has an end in contact with the fixing rollers. A groove is formed at an intermediate portion of the separating member. A housing for the separating member has an engaging portion to engage with the groove so as to rotatably support the separating member around the engaging portion. A tension spring is connected to the separating member and exerts a force in a direction such that the separating member is brought into contact with the mixing rollers.

3 Claims, 3 Drawing Sheets

TONER IMAGE FIXING DEVICE

BACKGROUND OF THE INVENTION

The present invention relates to a toner image fixing device including fixing rollers which fix a toner image on a sheet of paper while gripping and transporting the sheet and a separating device which separates the sheet of paper wrapped on the fixing rollers by bringing a separating member into contact with the fixing rollers.

A fixing device in an image formation apparatus, such as an electrophotographic copying machine or electrophotographic printer, typically includes a heating roller and a press roller. A sheet of paper onto which a toner image has been transferred in a previous stage is gripped between the fixing rollers and the toner image is fixed on the sheet by heat and pressure.

In this fixing device, since the sheet is liable to stick to the heating roller, a separating device with a separating member is brought into contact with the heating roller. The sheet is forcibly separated from the heating roller by the separating device following fixing.

A conventional separating member is rotatably supported by a shaft which passes through a mounting hole formed in its mounting portion. Further, a tension spring has one end connected to a separating device main body made of plate metal and its other end connected to separating member, whereby a pawl portion of the separating member is urged into contact with the heating roller. Typically, a number of separating members are mounted on the same shaft.

The shaft is horizontally set by being inserted in mounting holes that are formed in support tab portions at opposite ends of the separating device main body and it has E rings fitted on its opposite ends to hold the shaft in place.

The separating device is mounted in the image formation apparatus by fixing the separating device main body by suitable mounting means to a mounting section.

With this conventional structure, however, it is not possible to remove any of the separating members unless one first dismounts the separating device, which is made as a unit, from the mounting section and then removes E rings and pulls out the shaft. Consequently, the work of disassembly for replacing the separating members is very troublesome and time-consuming. A further problem has been that the necessity of having the shaft increases the weight and constitutes an obstacle to make the device lightweight and also makes the cost higher.

SUMMARY OF THE INVENTION

Accordingly, it is an object of the present invention to provide an improved toner image fixing device which permits easy replacement of a separating member.

It is a further object of the present invention to provide a toner image fixing device with a separating device which is of simple construction.

It is still a further object of the present invention to provide a toner image fixing device which makes it possible to reduce weight and cost.

In accordance with the present invention, the foregoing objects, among others, are achieved by providing a separating member which has an intermediate engaging portion having a first contact portion at an outer edge of the separating member. The main body of the separating device has a second contact portion at an outer edge. The first contact portion removably rests against the second contact portion. When the separating member is biased against the fixing roller, contact between the first contact portion and the second contact portion causes the main body to support the separating member. Yet the separating member can be easily removed from the main body by releasing the biasing spring and moving the separating member away from the main body.

BRIEF DESCRIPTION OF THE DRAWINGS

A more complete appreciation of the present invention and many of its attendant advantages will be readily obtained by reference to the following detailed description considered in connection with the accompanying drawings, in which.

DETAILED DESCRIPTION OF THE PREFERRED EMBODIMENT

Figure 1:
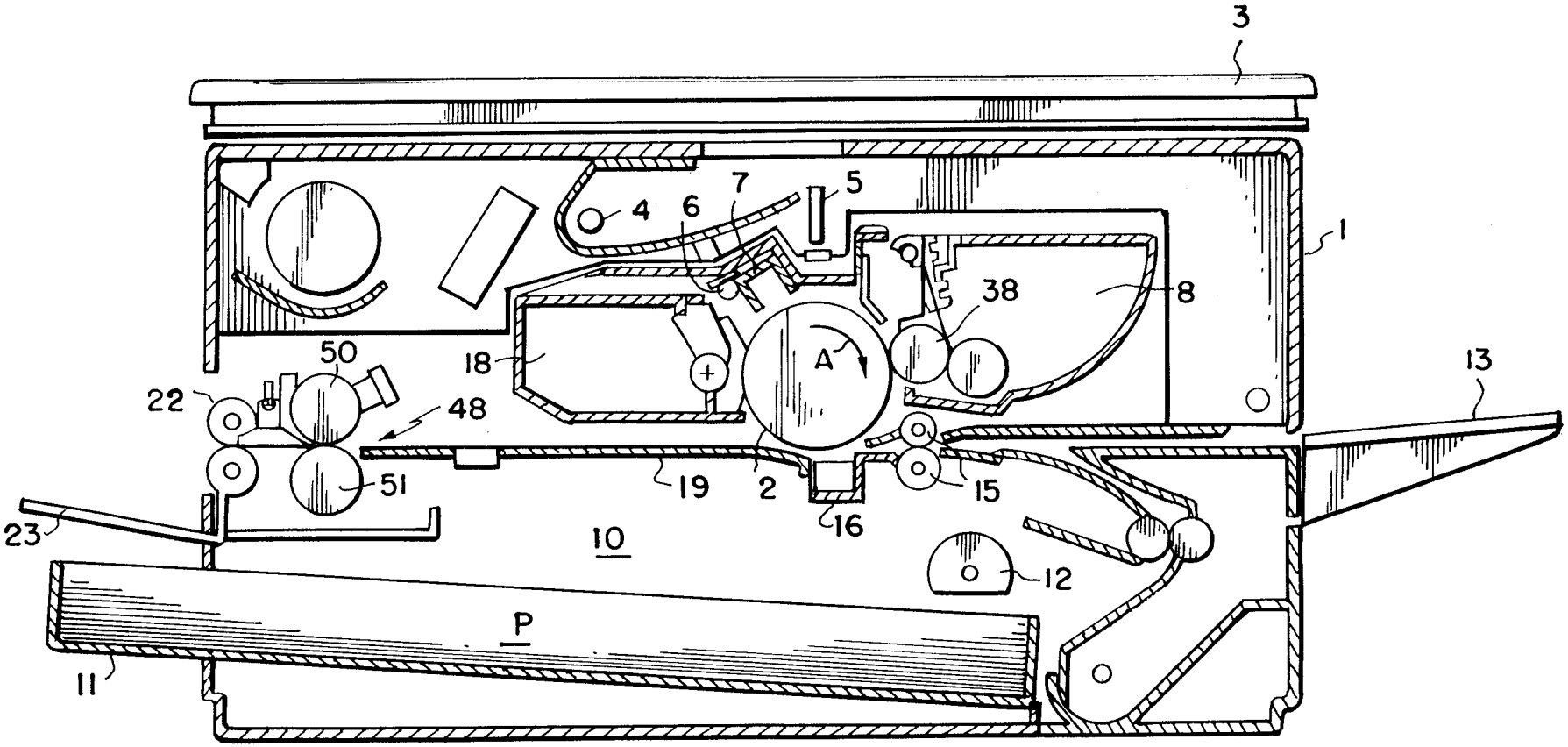
FIG. 1 is a schematic sectional view of a copying machine using a toner image fixing device according to the present invention.
Figure 2:
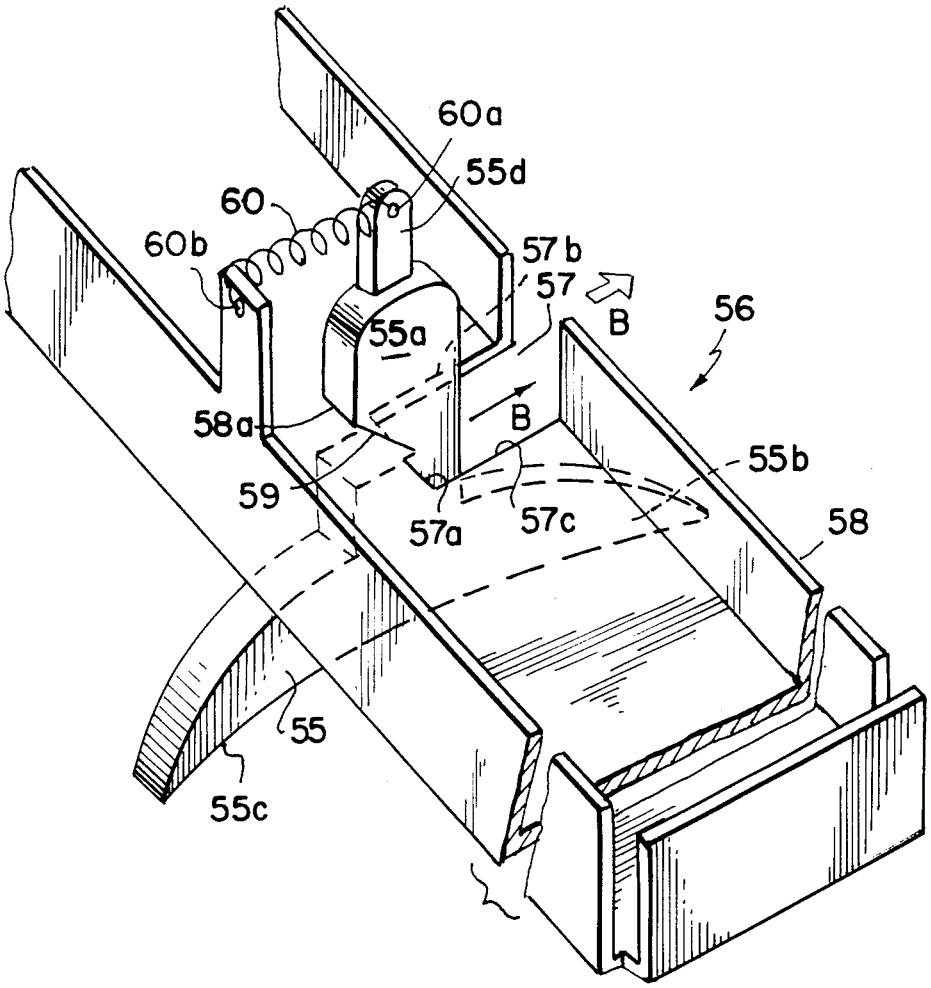
FIG. 2 is a perspective view of a separating device according to the present invention.
Figure 3:
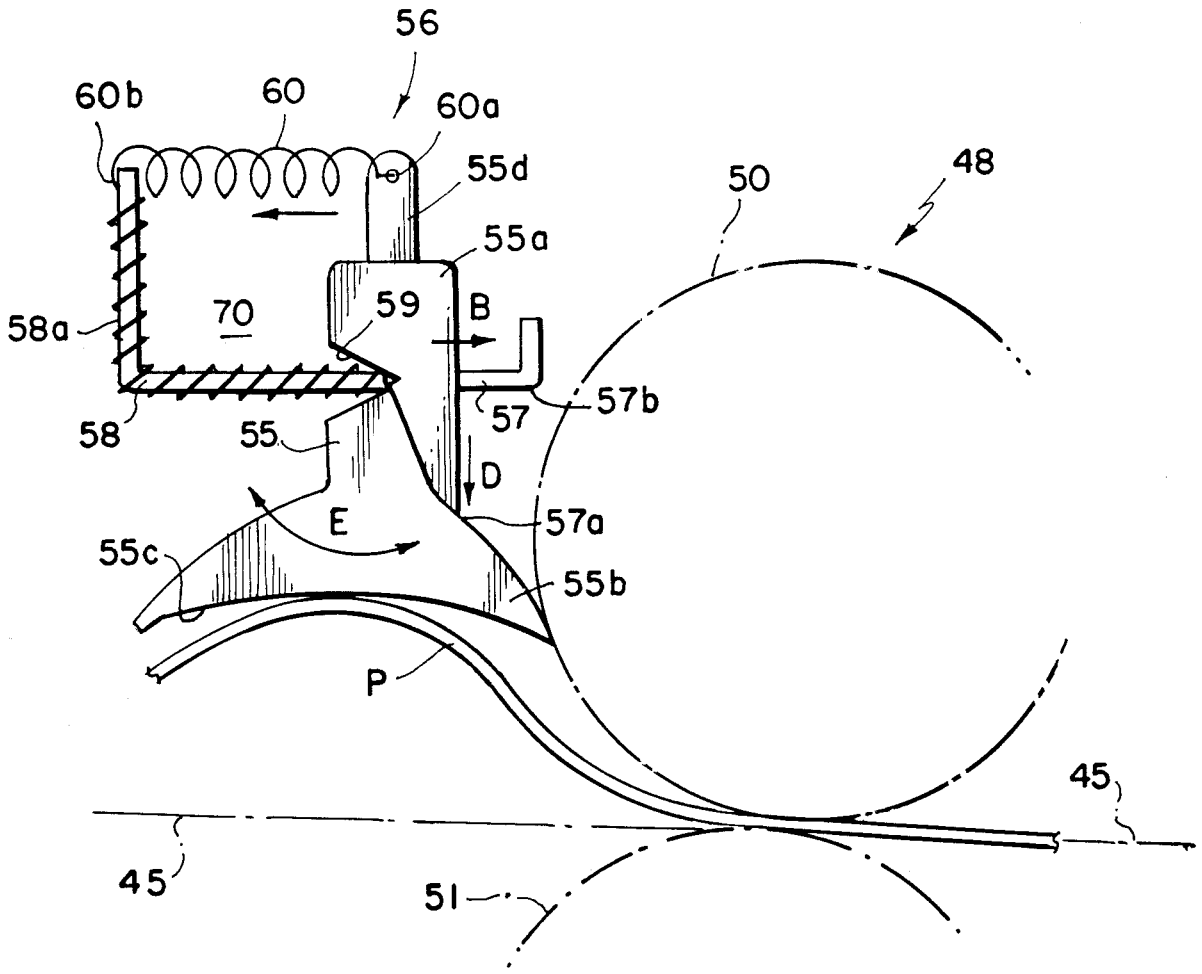
FIG. 3 is a sectional view of a toner image fixing device according to the present invention.

A toner image fixing device according to the preferred embodiment of the present invention will be described with reference to FIGS. 1 to 3.

A copying machine to which the toner image fixing device according to the present invention may be applied will be described. Referring to FIG. 1, reference numeral 1 denotes a copying machine housing. A photosensitive drum 2, having a photosensitive film such as a selenium film thereon, is rotatably (in a direction indicated by arrow A) arranged at substantially the center of housing 1. An electrostatic latent image is formed on the surface of photosensitive drum 2 as an image carrier. A lamp 4 and a converging optical transmission member 5 optically scan a document placed on reciprocally driven document table 3, focus a document image on a surface portion of photosensitive drum 2 and form a latent image on the surface portion. Arranged around photosensitive drum 2 are a discharge lamp 6 for discharging the surface of photosensitive drum 2 before the document image is focused thereon, a charger 7 for uniformly charging the surface of photosensitive drum 2 after the surface of photosensitive drum 2 is uniformly discharged, and a developing apparatus 8 for applying the toner to the latent image formed on the surface of the photosensitive drum and for developing the latent image. A visible image is formed by developing apparatus 8 on photosensitive drum 2.

A sheet feeding section is arranged on opposite sides of housing 1. The sheet feeding section comprises a paper cassette 11, detachably mounted on one side of the copying machine, and sheet feeding rollers 12, brought into rolling contact with uppermost sheet P so as to feed sheet P to the inside of housing 1. A manual feeding guide 13, for manually guiding a sheet, is arranged on the other side of the copying machine. The sheet fed from the sheet feeding section is aligned by register rollers 15 and is fed to a transfer portion of photosensitive drum 2 while the sheet is brought into slidable contact with the transfer portion.

A transfer charger 16 for transferring the visible image onto sheet P is arranged around photosensitive drum 2. The transfer portion described is defined between photosensitive drum 2 and transfer charger 16. The sheet having the toner image (visible image) thereon is guided by a conveyor belt 19 to a toner image fixing unit 48 according to the present invention. The toner on the sheet is fixed by toner image fixing unit 48. The sheet having the fixed image is discharged by a pair of discharge rollers 22 onto tray 23. The residual toner remaining on the surface of photosensitive drum 2 after the transfer operation can be removed by a cleaning unit 18.

Toner image fixing device 48 according to the present invention is described with reference to FIGS. 2 and 3.

Toner image fixing device 48 has fixing rollers including a heating roller 50 and a press roller 51 which are in rolling contact with one another. A sheet of paper P having a toner image T thereon is forwarded along a sheet transport route 45. Then, sheet P is gripped between heating roller 50 and press roller 51. Consequently, sheet P is transported by these rollers 50, 51 while at the same time toner image T is fixed by heat and pressure. Adjacent heating roller 50, there is provided a separating device 56 which has a separating member 55 in contact with heating roller 50 and serves to forcibly separate sheet P from heating roller 50 following fixing. Separating device 56, which is made as a unit, is mounted in a mounting section 70 inside an image formation apparatus main body and has a construction as shown in FIGS. 2 and 3.

In more detail, a holder member 58 for holding separating member 55 takes the form of a generally U-shaped cross-sectional casing. Holder member 58 constitutes a separating device main body and is fixed by a mounting member (not shown) in mounting section 70 provided near heating roller 50. Separating member 55 is formed in the approximate shape of an inverted T and comprises engaging portion 55*a*, a separating portion including a pawl portion 55*b* and a sheet guide portion 55*c*, and a biasing portion 55*d*. In an edge of holder member 58 that is on the heating roller 50 side of holder member 58 there is formed a first engagement groove 57 into which engaging portion 55*a* of separating member 55 is inserted. Groove 57 has a contact portion which contacts engaging portion 55*a*. The width of first groove 57 is approximately equal to the thickness of engaging portion 55*a*. In an edge that is at an intermediate portion of engaging portion 55*a*, there is formed a second engagement groove 59 on the side that is opposite to rollers 50 and 51. Groove 59 also has a contact portion which removably rests against the contact portion of groove 57. Thus, second engagement groove 59 has a generally V-shaped cross-section and is engaged by first engagement groove 57, whereby separating member 55 is supported by holder member 58 in a manner permitting rotation thereof as indicated by arrow E in FIG. 3. Accordingly, opposite-side edge portions 57*b* and 57*c* of first engagement groove 57 serve to effect positioning in the direction of the thickness of separating member 55, i.e., in the direction of the length of holder member 58, while positioning in the vertical direction is effected by engagement of second engagement groove 59 with end edge portion 57*a* of first engagement groove 57. A tension spring 60 is stretched with one end 60*a* connected to biasing portion 55*d* and its other end 60*b* connected to a spring mounting tongue 58*a*. Spring mounting tongue 58*a* extends from and is integral with holder member 58. Tension spring 60 exerts a force constantly urging pawl portion 55*b* of separating member 55 into contact with heating roller 50.

Of course, numerous separating members 55 can be housed in holder member 58.

Sheet guide portion 55*c* faces sheet transport route 45. With this structure, sheet P on which toner image T is fixed is forcibly separated from fixing rollers 50, 51 by pawl portion 55*b* of separating member 55. After separating, sheet P is transported while guided along sheet transport route 45 by sheet guide portion 55*c* of separating member 55.

To remove separating member 55 in separating device 56 thus constituted, one end of tension spring 60 is detached and then separating member 55 is moved in the direction of arrow B to disengage second engagement groove 59 and end edge portion 57*a* of first engagement groove 57. Following this, separating member 55 can be detached by pulling it downwards. To mount a separating member it is simply necessary to follow the reverse procedure to that followed for removal. Thus, separating member 55 can be replaced very easily since there is no need for holder member 58 that also serves as the separating device main body to be dismounted from mounting section 70 in image formation apparatus main body when replacement is effected.

Numerous modifications and variations of the present invention are possible in light of the above teachings. It is therefore to be understood that, within the scope of the appended claims, the present invention can be practiced in a manner other than as specifically described herein.

What is claimed is:

1. A toner image fixing device comprising:

means for fixing a toner image on an image forming medium;

means for separating the image forming medium from said fixing means, said separating means having a separating portion which is in contact, with said fixing means, a biasing portion and an engaging portion provided between said separating portion and said biasing portion, said engaging portion having a first contact portion at an outer edge of said separating means;

means, provided in the vicinity of said fixing means, for engaging said engaging portion, said engaging means having a second contact portion at an outer edge of said engaging means, said first contact portion, removably resting against said second contact portion; and means, connected to said biasing portion of said separating means, for exerting a force in a direction so that said separating means touches said fixing means and contact between said first contact portion and said second contact portion causes said engaging means to rotatably support said separating means.

2. The toner image fixing device according to claim 1, wherein said engaging portion comprises an engagement groove which is formed in an edge of said separating means which is opposite to said fixing means, said first contact portion being disposed in said groove.

3. The toner image fixing device according to claim 2, wherein said engaging means comprises a second engagement groove which is formed in an edge of said engaging means which is towards said fixing means, said second contact portion being disposed in said second engagement groove.

* * * * *